US008097122B2

(12) United States Patent
McPherson

(10) Patent No.: US 8,097,122 B2
(45) Date of Patent: Jan. 17, 2012

(54) PAPERMAKING MACHINE DEWATERING BLADE INCORPORATING ATTACHMENT MECHANISM

(75) Inventor: Douglas R. McPherson, East Granby, CT (US)

(73) Assignee: AstenJohnson, Inc., Charleston, SC (US)

( * ) Notice: Subject to any disclaimer, the term of this patent is extended or adjusted under 35 U.S.C. 154(b) by 78 days.

(21) Appl. No.: 12/599,711

(22) PCT Filed: May 20, 2008

(86) PCT No.: PCT/US2008/064214

§ 371 (c)(1),
(2), (4) Date: Nov. 11, 2009

(87) PCT Pub. No.: WO2008/147766

PCT Pub. Date: Dec. 4, 2008

(65) Prior Publication Data

US 2010/0236739 A1 Sep. 23, 2010

Related U.S. Application Data

(60) Provisional application No. 60/939,644, filed on May 23, 2007.

(51) Int. Cl.
*D21F 1/10* (2006.01)
*D21G 9/00* (2006.01)

(52) U.S. Cl. ..... 162/100; 162/351; 162/352; 162/354; 162/374; 210/400

(58) Field of Classification Search ..... 162/351, 162/352, 354, 374, 100; 210/400
See application file for complete search history.

(56) References Cited

U.S. PATENT DOCUMENTS

| | | | | |
|---|---|---|---|---|
| 3,337,394 | A | 8/1967 | White et al. | |
| 3,520,775 | A | 7/1970 | Truxa | |
| 3,535,204 | A * | 10/1970 | Truxa | 162/352 |
| 3,647,620 | A | 3/1972 | Truxa | |
| 3,743,574 | A | 7/1973 | Walser et al. | |
| 3,953,284 | A | 4/1976 | Evalahti | |
| 4,004,969 | A | 1/1977 | Beauchemin | |
| 4,214,949 | A | 7/1980 | Schiel et al. | |
| 4,265,706 | A * | 5/1981 | Fulton | 162/352 |
| 4,544,449 | A | 10/1985 | Arav | |
| 5,076,894 | A | 12/1991 | Simmons et al. | |
| 5,630,910 | A * | 5/1997 | McPherson | 162/352 |
| 5,932,072 | A | 8/1999 | Neun et al. | |
| 6,537,426 | B2 | 3/2003 | Haunlieb | |
| 7,169,264 | B2 | 1/2007 | Bartelmuss | |
| 7,540,943 | B2 * | 6/2009 | McPherson | 162/374 |
| 7,799,174 | B2 * | 9/2010 | Bartelmuss et al. | 162/352 |
| 2004/0238142 | A1 * | 12/2004 | Bartelmuss et al. | 162/353 |
| 2008/0087398 | A1 * | 4/2008 | Bartelmuss et al. | 162/352 |

* cited by examiner

FOREIGN PATENT DOCUMENTS

| | | |
|---|---|---|
| CA | 1235010 | 4/1988 |
| WO | 0022229 | 4/2000 |

*Primary Examiner* — Eric Hug
*Assistant Examiner* — Peter Chin
(74) *Attorney, Agent, or Firm* — Volpe and Koenig, P.C.

(57) ABSTRACT

Segments, typically ceramic, for use in dewatering blades for papermaking and similar machines comprise lower surfaces to each of which at least one interlock member is bonded. The segments are installed by inserting the interlock members into a channel in an intermediate sub-assembly or base member. The members are securely attached within the channel by a suitable adhesive, or clip means to engage the interlock members, with the optional addition of an adhesive. The segments and dewatering blades, and a method of manufacture, allows for the segments to be made as flat units, without unnecessary angular surfaces, simplifies their attachment to the base, and reduces the occurrence of stress cracking or other damage to the segments. A single segment can be used in various dewatering blade types and in more than one orientation in dewatering blades, reducing manufacturing costs by unitizing construction.

29 Claims, 10 Drawing Sheets

FIGURE 7A
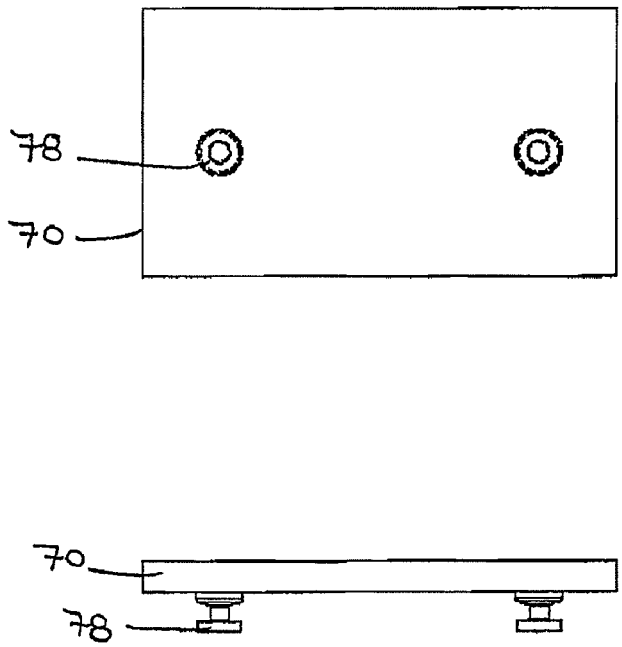
FIGURE 7B
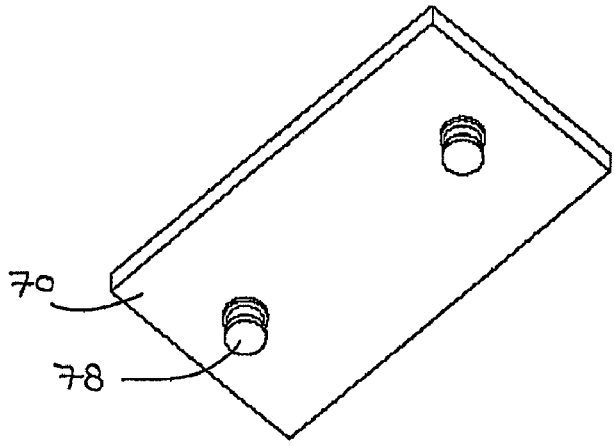
FIGURE 7C
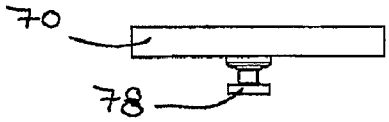
FIGURE 7D

PAPERMAKING MACHINE DEWATERING BLADE INCORPORATING ATTACHMENT MECHANISM

BACKGROUND

The present invention concerns dewatering blades for use in the forming and press sections of papermaking and similar machines, the blades comprising segments whose upper surfaces together comprise the fabric contacting surface of the blade, and in particular the bonding of one or more interlock members to the lower surface of the segments to interlock be secured within a channel within a base member.

Dewatering blades have been used for many years in the papermaking and similar industries to scrape or foil fluid from the undersides of fabrics so as to consolidate a mat or web, and to induce agitation in the stock carried by forming fabrics; many different designs are known and used. Although the present invention is described primarily in relation to the papermaking arts, the person skilled in the art will readily appreciate that the invention will find utility in all types of related continuous consolidation processes, such as sludge dewatering and filtration.

The fabric contact surfaces of these dewatering blades are typically comprised of carefully and precisely shaped segments of a ceramic or similar wear resistant material that are either bonded or mechanically attached in some manner to a base member. Typically the base member spans the full width of the machine and provides a firm base for the attachment of the ceramic segments; however, a sub-assembly system can be used, as described in our co-pending application U.S. Ser. No. 11/690,479. The fabric contacting surfaces of the segments are carefully shaped for engagement with the fabrics which pass over them in sliding contact. The machine side surfaces of the segments are typically shaped to fit a dovetail or other similar interlocking shape on the base member, as is well known in the art. FIG. 1 provides an illustration of the cross-section of a typical known ceramic segment of the prior art, showing the molded dovetail shape on the underside of the segment which is designed to mate with the fibreglass base member which is in turn mounted on a rail typically located on the top of a suction or other drainage box. This construction results in a substantial difference in thickness of the segment (measured from the upper to lower surfaces) at the location over the base member channel as compared to the areas upstream and downstream of same.

The prior art contains many examples of methods and apparatus to attach the segments to the base member; almost all rely on the basic dovetail and T-bar method disclosed by White et al. in U.S. Pat. No. 3,337,394. This patent teaches that drainage blades can be provided with a dovetail type recess adapted to fit over a T-shaped rail so as to mount them on the papermaking machine. The advantage of the method is that the blades are replaceable by sliding them off the rail and sliding a new one into position. The system also allows for accurate positioning of the blades in relation to the fabrics. Other examples are known.

Truxa in U.S. Pat. Nos. 3,520,775 and 3,647,620 teaches a means of adjusting the position of the blades relative to the papermaking fabric using a slot and pin type of arrangement. U.S. Pat. No. 3,743,574 to Walser et al. teaches a mounting system similar to White et al. U.S. Pat. No. 3,953,284 to Evalahti discloses a locking means for a T-bar type blade similar to that disclosed by White et al. Beauchemin in U.S. Pat. No. 4,004,969 discloses a removable wear resistant insert that is slidable into position to change foiling angles. U.S. Pat. No. 4,214,949 to Schiel et al. discloses a symmetrical blade adapted to be clamped to a support element by a leaf spring clip to provide interchangeable bearing surfaces. U.S. Pat. No. 4,544,449 to Arav discloses a mounting system for blades whereby the blades are secured to a "plank" by means of a series of pins which are welded to and project from the plank; the system is easy to manufacture and requires minimal machining.

U.S. Pat. No. 5,932,072 to Neun et al discloses mounting means in the form of "buttons" which hold the blades in position, replacing the traditional T-bar mounting means. Each blade includes a T slot on its lower side that is slid over the buttons; each button is comprised of a threaded cylindrical stem portion which engages with the machine frame and an upper cap.

U.S. Pat. No. 6,537,426 to Haunlieb discloses a connecting element or clamping means for releasably and adjustably securing a blade to the cover of a drainage device. Fasteners equipped with sleeves and located on the cover engage with angled slots in the underside of the blade mounting.

EP 1,127,186 to Jansson discloses a method of mounting a foil or blade whereby the blade is pushed into a stable operating position by means of springs which cause a locking member to engage clamping surfaces which hold the blade rigidly in position. An actuator is provided to allow the blade to be dismounted.

CA 1,235,010 to Fuchs discloses a blade comprised of ceramic segments which are comprised of upper and lower portions, the lower portions having projections which are arranged to be attached to a base member. The upper and lower portions are cemented together, but in an offset arrangement, such that each joint between adjacent lower portions is located partway between the joint between adjacent corresponding upper portions.

Currently, segments (typically ceramic) for use in papermaking dewatering blades are manufactured in one of three ways:

1. The ceramic is formed (i.e. cast) with an integral interlocking mechanism, such as a dovetail or tee shape, cast into the machine side surface of the segment. This interlocking shape is used in conjunction with a mating slot or protrusion in the base member to lock the components together. Epoxy is often used to facilitate this locking mechanism.
2. The ceramic segments are manufactured as flat rectangular components that are bonded directly to the base substructure with an epoxy suitable for use in a hot, wet, environment.
3. The segments are produced similar to (2) but they are cut with a groove that allows a steel clip to be inserted to aid in the interlock with the epoxy and the carrier base.

There are problems associated with all three of these current methods. In the first, the variation in the thickness of the ceramic (i.e. from the paper side surface to the bottom of the blade at its leading and trailing edges (T1 and T2) as compared to the interlocking portion at the base where the dovetail occurs and the ceramic increases in thickness as shown at T3 in FIG. 1) can lead to stress build up at the location of the profile change 17. This stress build-up causes stress cracks to form in the ceramic segments, subsequently leading to further cracking and ultimate failure of the segment. In addition, this locking means is costly to manufacture, and for various reasons can provide an unsatisfactory join between the base and ceramic segment.

In the second method, there is a strong possibility due to variations in the bonding process, or as a result of machine operating conditions, that one or more of the bonded ceramic segments may come loose from the base structure during machine operation, causing significant damage to the papermaking fabric and possibly the machine components. In the method disclosed by Fuchs, in CA 1,235,010, a very high accuracy of alignment is required, which is difficult to achieve having regard to the typical small sizes of the ceramic segments, and such construction is extremely difficult to repair in the event of damage to any of the segments.

In the third instance, the cutouts made in the bottom of the ceramic to accept the clips can also result in stress cracks forming in the ceramic segments, or they may reduce the usability of the ceramic due to the chance of breaking through into the cutouts.

It is thus desirable to provide a more efficient and cost effective means whereby the ceramic segments could be reliably and efficiently bonded to the base without danger of their being disconnected and causing damage to either the papermaking machine or its components, in particular the papermaking fabrics. It would also be desirable if the ceramic segments could be produced in a more reliable and efficient manner, in particular without the significant differences in thickness, so that stress cracking in the segments could be reduced to a great extent, and one segment could serve a variety of purposes in a given blade configuration.

Thus, there is a need in the filtration process industry, and in particular the papermaking industry, for a more reliable and cost effective means of attaching the ceramic segments comprising the fabric contacting surfaces of dewatering blades and the like to the base members upon which they are mounted. The present invention provides a simple but effective means of overcoming these and other difficulties relating to the attachment of the ceramic segments to the base member.

SUMMARY

The present invention provides a novel reliable and cost effective means for improving the attachment of segments, such as conventional ceramic segments, to the base member of dewatering blades for filtration. In the invention, one or more secondary interlock members are bonded to the machine side surfaces of the segments; the assembly consisting of the segment and at least one interlock member is then attached to the base member, by securing the interlock member within a channel in the base member, by means of an adhesive or a locking mechanism which is designed for use with or without an additional bonding agent.

For the purposes of this invention, the term "adhesive" is to be broadly construed as meaning any compound that adheres or bonds two or more items together, examples of which include thermoplastic adhesives, reactive adhesive systems, and LTV and light curable adhesives. Selection of a suitable adhesive for use in the practice of the present invention will be made by the practitioner based on the environmental conditions to which the adhesive will be exposed.

Thus in a first broad embodiment, the present invention seeks to provide a segment for a blade for dewatering a filtration fabric in a filtration process, the blade including a base carrier comprising a channel, the segment having a leading edge and a trailing edge and comprising (i) a fabric-contacting upper surface;
(ii) a lower surface; and
(iii) at least one interlock means bonded by an adhesive to the lower surface of the segment, the interlock means being constructed and arranged to be received and secured within the channel.

In a second broad embodiment, the present invention seeks to provide a dewatering blade for a filtration fabric, comprising (i) a base carrier having at least one channel
(ii) a plurality of segments each having a leading edge and a trailing edge and comprising
(a) a fabric-contacting upper surface;
(b) a lower surface; and
(c) at least one interlock means bonded by an adhesive to the lower surface of the segment and having a free end received and secured within the channel.

In a third broad embodiment, the present invention seeks to provide a method of making a dewatering blade for a filtration fabric, comprising the steps of (i) providing a base carrier having at least one channel
(ii) providing a plurality of segments each having a leading edge and a trailing edge and comprising
(a) a fabric-contacting upper surface;
(b) a lower surface; and
(c) at least one interlock means bonded by an adhesive to the lower surface of the segment and having a free end portion; and
(iii) securing the segments to the base carrier by securing the free end portion of the interlock means within the at least one channel.

The interlock means comprise interlock members which can be individually bonded directly onto the lower surface of the segments, or alternatively can be mounted in a plurality on a strip which is then bonded onto the lower surface of the segments. The number of interlock members provided to each segment will depend on various factors, including the size of the segments, the configuration of the base carrier, the intended end use of the blade, and the selected configuration of the interlock members and their materials of construction.

Preferably, the interlock members have a varied cross-section along the direction from the bonded end to the free end, such that there is an indented intermediate portion, which facilitates securing within the channel.

Preferably, an adhesive material is included in the channel so as to solidify the attachment. Alternatively, the channel is provided with a snap/fit mechanism which engages the indented portions of the interlock members.

BRIEF DESCRIPTION OF THE DRAWINGS

The invention will now be described with reference to the drawings, in which

FIGS. 7A to 7D are respectively a top plan view, side view, perspective view and end view of a segment of a fifth embodiment of the invention.

DETAILED DESCRIPTION OF THE PREFERRED EMBODIMENTS

Figure 1:
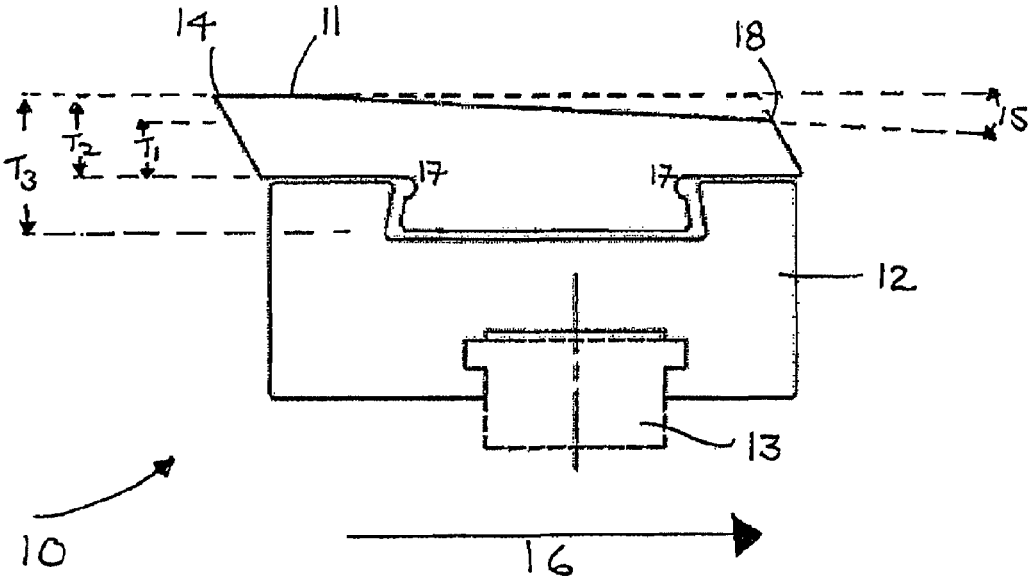
FIGURE 1 (Prior Art)
FIG. 1 is a cross section taken in the MD through a segment, base carrier and T-bar rail of the prior art.

As discussed above, FIG. 1 shows the typical configuration of a blade assembly 10 of the prior art, in cross-section in the machine direction as shown by arrow 16. Segment 11, having a profiled upper surface with a downward slope, comprising foiling angle 15, from the leading edge 14 towards the trailing edge 18, has a lower surface profiled to provide the conventional dovetail installation into the corresponding passageway in the base carrier 12, which is in turn mounted on a T-bar rail 13. The differences in thickness between the segment 11 at the leading edge 14 and the trailing edge 18, shown in FIG. 1 as T1 and T2, and the difference between each of those thicknesses and the greatest thickness of the segment 11 at the dovetail area, T3, can readily be seen.

Figure 2A:
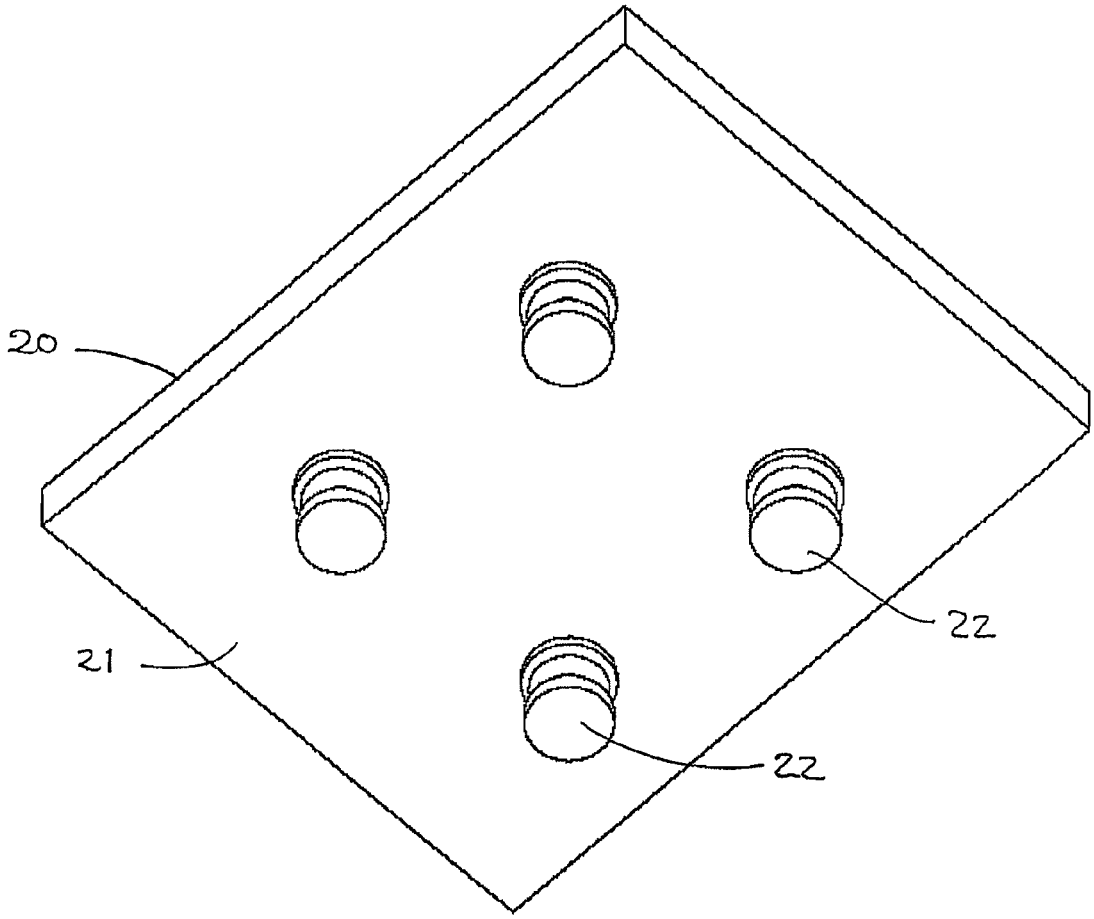
FIGS. 2A, 2B and 2C are respectively a perspective view, a top plan view and a side view of a first embodiment of the segments of the invention.
Figure 2B:
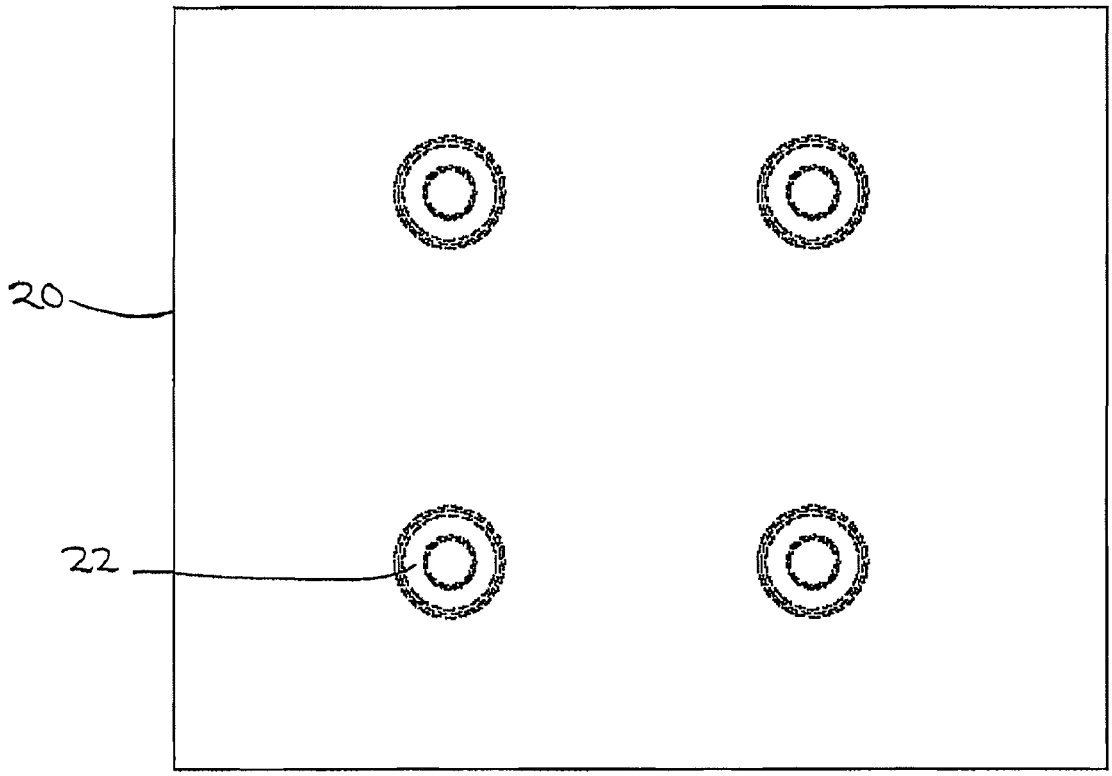
Figure 2C:
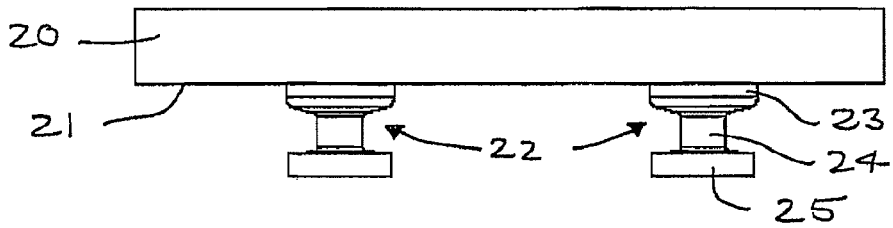

Referring to FIGS. 2A, 2B and 2C, showing a first embodiment of the invention, a flat segment 20 has a lower surface 21 to which are bonded four interlock members 22, each comprising bonded end 23, intermediate portion 24 and free end 25. The interlock members 22 are constructed to engage corresponding channels in corresponding base carriers (not shown).

Figure 3A:
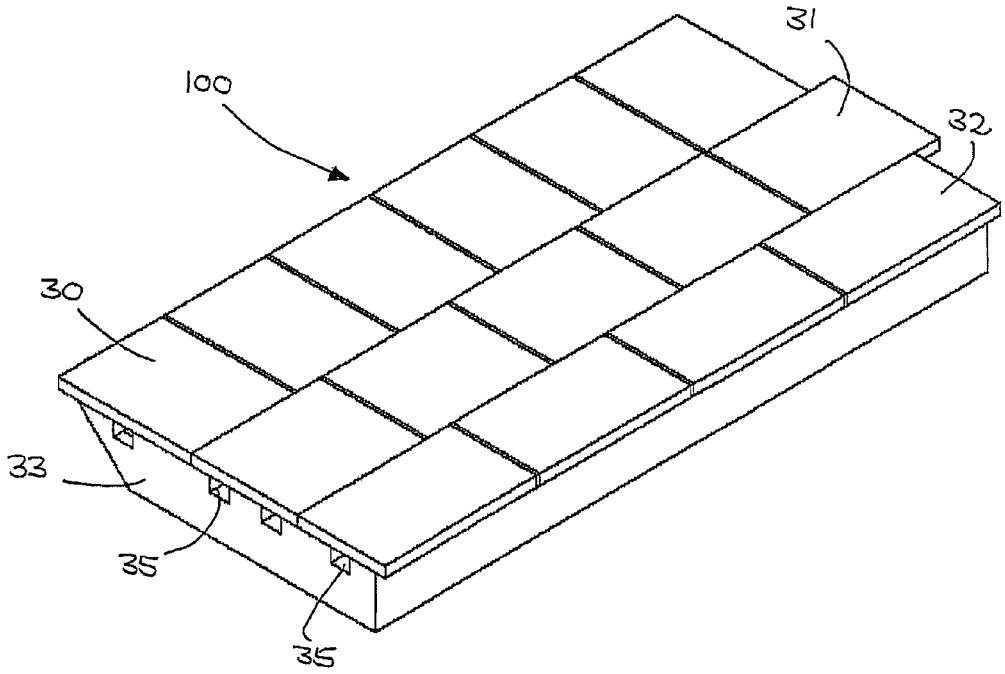
FIGS. 3A and 3B are respectively a perspective view and a side view of a forming board embodying the invention.
Figure 3B:
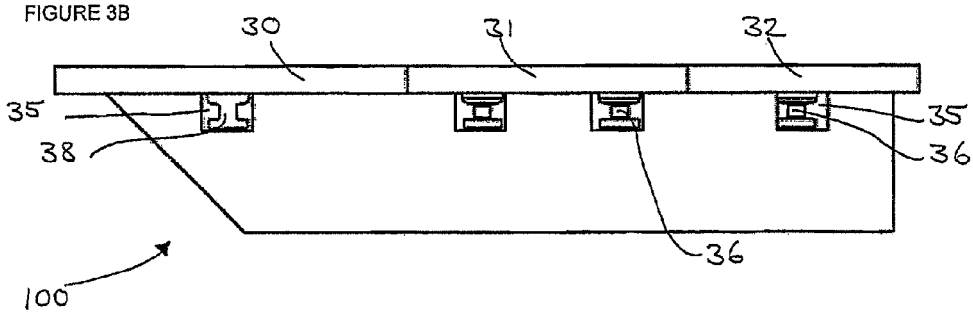

FIGS. 3A and 3B show a forming board 100 in which a plurality of segments 30, 31 and 32 are mounted onto a base carrier 33; in this exemplary embodiment, the rectangular segments 30 of the first row are oriented in the machine direction, while the segments of the second and third rows 31 and 32 are rotated 90° and are thus oriented in the cross-machine direction, but the segments 31 are offset relative to the segments 30 and 32 and have different dimensions from those of segments 30 and 32. The interlock members 36, 38 are inserted into channels 35 in the base member 33. The segments 31 correspond with the embodiment shown in FIGS. 2A, 2B and 2C.

Figure 4A:
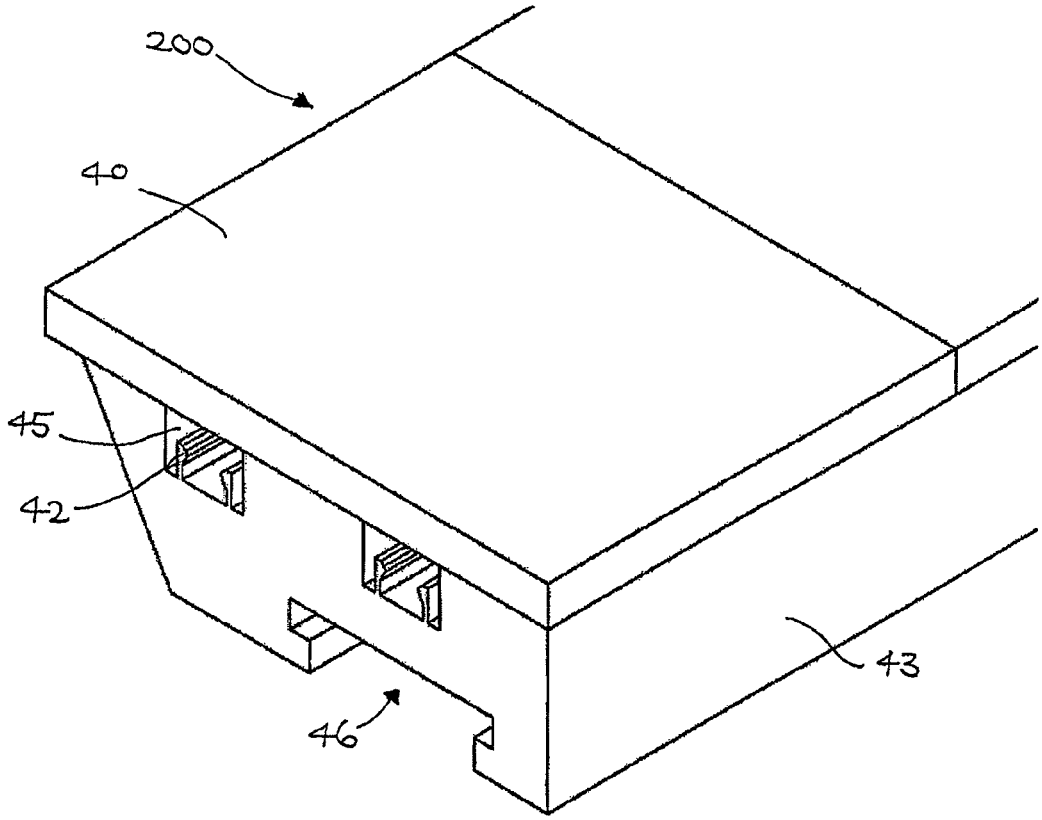
FIGS. 4A and 4B are respectively a perspective view and a side view of a blade assembly of segments comprising a second embodiment of the invention.
Figure 4B:
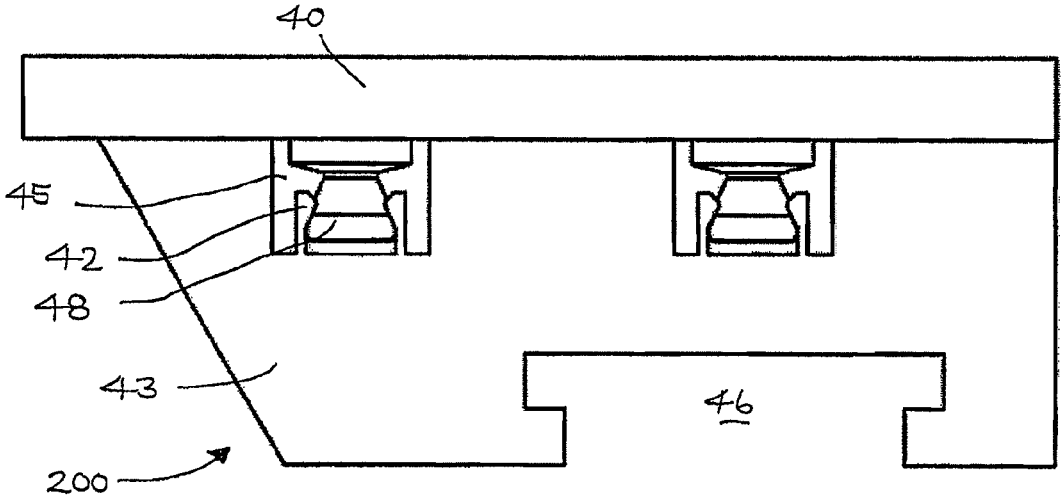
Figure 5A:
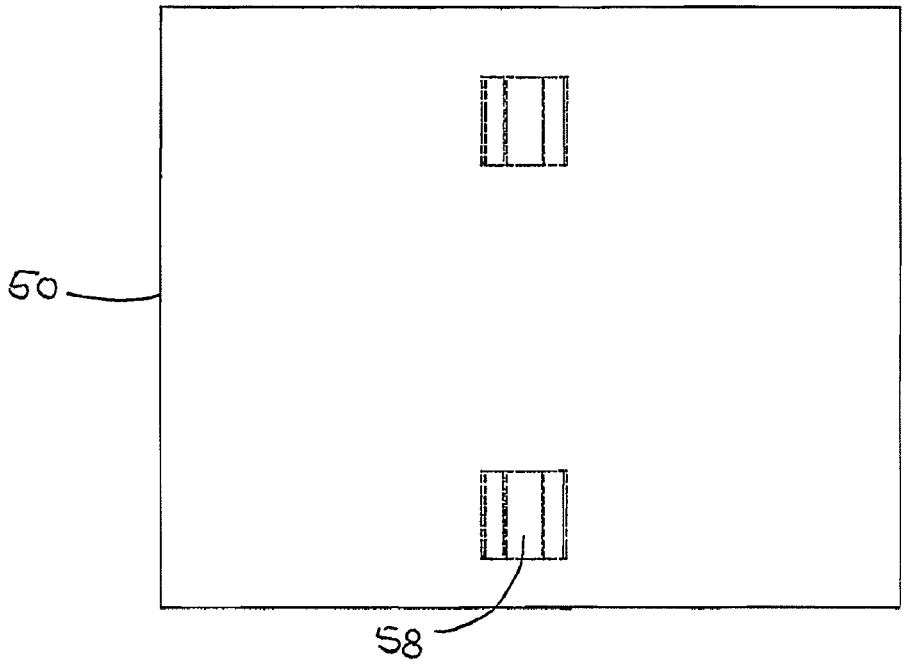
FIGS. 5A to 5D are respectively a top plan view, a front perspective view, a side view and an end view of a segment of a third embodiment of the invention.
Figure 5B:
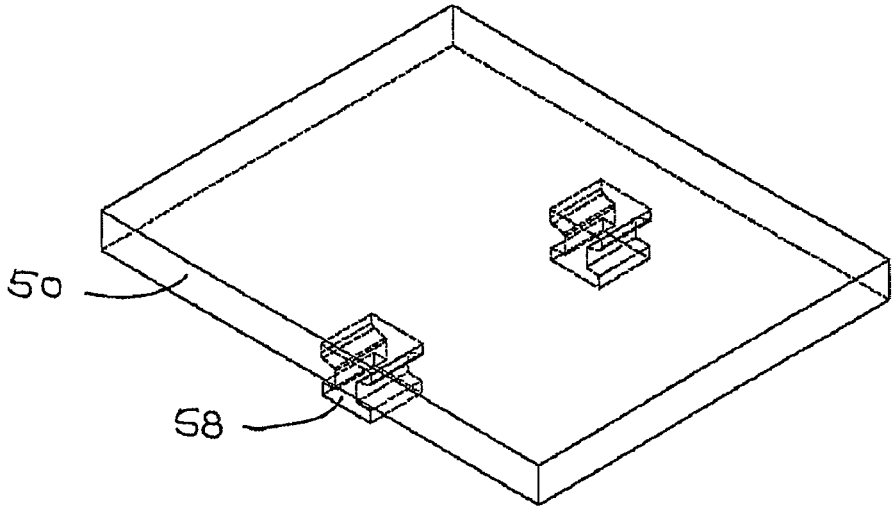
Figure 5C:
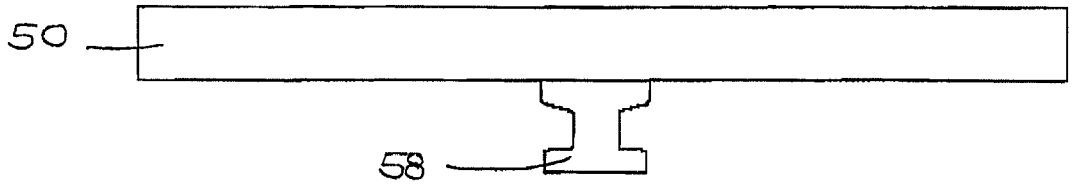
Figure 5D:
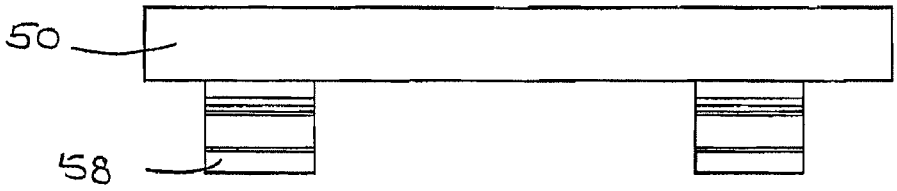

FIGS. 4A and 4B illustrate a further embodiment of a blade assembly 200, having a snap-in or compression locking arrangement of the interlock members 48 in which no adhesive would be required. In this exemplary embodiment, the interlock members 48 are inserted into channel 45 of base member 43, and secured by clip members 42. The base member 43 is provided with a T-slot 46 to enable it to be slid onto a mounting rail (not shown).

FIGS. 5A, 5B, 5C & 5D illustrate a further embodiment in which segment 50 has two rotated H-shaped interlock members 58 bonded to its machine side surface, which can be inserted into a channel in a base member (not shown) in the same manner as the interlock members 48 shown in FIGS. 4A and 4B.

Figure 6A:
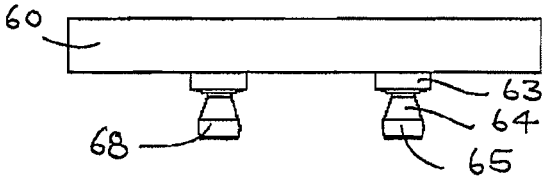
FIGS. 6A and 6B are respectively side and end views of a segment of a fourth embodiment of the invention.
Figure 6B:
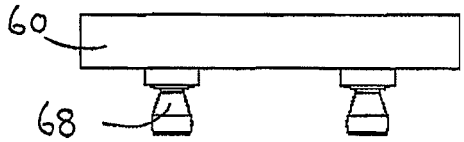

FIGS. 6A, 6B and 6C shows a further embodiment in which segment 60 has four interlock members 68 bonded to it, having a configuration in which the intermediate portion 64 between the bonded end 63 and the free end 65 is frustoconical, tapering towards the bonded end 61.

FIGS. 7A and 7B show an arrangement in which segment 70 has two interlock members 78 bonded to it.

Figure 8:
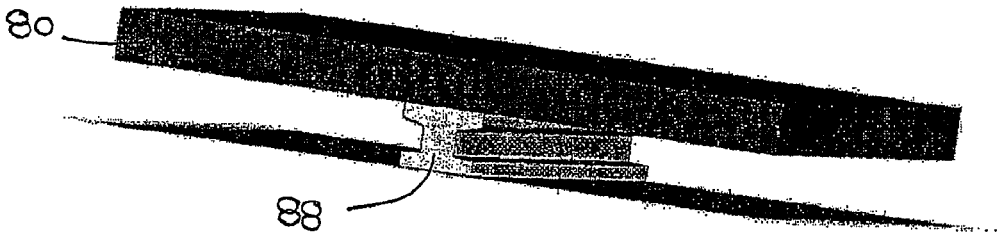
FIG. 8 is a perspective view of a segment of a sixth embodiment of the invention.

FIG. 8 shows a further embodiment in which rectangular segment 80 has a single rail shaped interlock member 88 bonded to it and running across its width.

In the present invention, the segments are produced in a substantially flat format without an integral channel or protrusion, thus allowing them to be manufactured at lower cost. By making the segments flat, the level of residual stress in the material is considerably reduced at their point of attachment to a base member in comparison to the more common shaped profiles of the prior art, making the segment less subject to cracking failures in operation and thus more reliable. The interlock means, for example interlock member 22 as shown in FIG. 2, is then bonded to the lower surface 21 of the segment 20, i.e. the surface that will in eventual use be located opposite the wear surface and which will be in contact with the mounting structure of the papermaking of other machine. Before the bonding, any desirable surface preparation can be performed to the lower surface 21, depending on the material of the segment 20, to optimize the bonding.

A particular advantage of this method of construction is that the bonding of the interlock members 22 to the segments 20 can be completed in a highly controlled and clean environment, thus ensuring a much higher quality bond than has been previously available. By utilizing smaller parts in the assembly of the ceramic segments, it is now possible to optimize environmental cleanliness, adhesives and curing temperature to ensure the reliable adhesion of the segments with the interlock members to a much greater extent than has been possible with prior art assemblies. It is thus possible to utilize almost any suitable material for the interlock members because there are a wide range of adhesives that would be appropriate for use in such applications. Examples of suitable materials include high performance plastics, stainless steel, ceramics, aluminium, bronze, and so on.

After bonding of the selected interlock members 22 to the lower surface 21 of the segment 20, the interlock members are then pressed or slid, depending on the embodiment, into a channel (for example channel 35 shown in FIG. 3) in the base member (for example base member 33 shown in FIG. 3). Suitable epoxies or other adhesives are used as appropriate, the selection of which will be made based on the environmental conditions to which the assembly will be exposed, in particular the usual conditions of high temperature and humidity. The bond between the finished segment and the base is the most fragile in the blade-base system (compared to that between the segment and the interlock member) but if this bond does fail, the interlocking member which is imbedded in the adhesive provides a mechanical lock to the base. By appropriate selection of the configuration of the interlock members and the channel in the carrier, and of the adhesive or the clip means, or both, the risk of the segments coming loose from the carrier base and damaging the fabric running on its upper surface is minimized or eliminated.

A further advantage is that when the interlock members have been placed into the channel for securing by an adhesive, they can be aligned with great precision while the adhesive is hardening, with substantially increased accuracy and significant costs savings.

After the adhesive is cured, the assembly comprising the segments and the base can be installed by known means according to the intended end use for the blade. After completion of the installation, the upper surfaces of the segments can be finished to provide the desired profile with precision, again according to the intended end use.

In addition to the reliability and economic benefits provided by the segments, blades and methods of the invention, there is also an increase in the versatility of the segments that can now be utilized as compared to the conventional designs which include an integral dovetail or tee. The interlock members can be placed in any suitable location on the segment thus allowing fewer types of segment configurations to be required for a wider range of applications, while allowing segments of the same design to be mounted in different orientations, for example as shown in FIG. 3A, as discussed above.

The invention also provides the possibility of using different interlock members and arrangements thereof. For example, the interlocking with the base carrier can be done in the form of a snap-in or compression lock, for example by clip members 42 as shown in FIG. 4. In this instance, the interlocking can be achieved without the use of an epoxy, but the holding power of the clip members can be augmented by the use of a suitable adhesive. The interlocking can also be done using a drop-in configuration such as shown in FIG. 5. Further, multiple interlock members can be used on a single segment, such as interlock members 68 as shown in FIG. 6, to allow a wide variety of shapes of segment to be used in a combination of two or more base units. Any suitable number of interlock members can be used on each segment, for example four as shown in FIG. 2, two as shown in FIG. 7, or a single rail as shown in FIG. 8. Alternatively, the interlock members can be bonded to a strip in a linear configuration, and the strip then bonded to the lower surface of the segment.

Ceramic segments currently in use typically have a length in the machine direction of between ½ inch and 3 inches, and a width in the cross-machine direction of between ½ inch to 1½ inches, but larger and smaller sizes are known and used. The dimensions of the interlock members can thus be selected so as to be compatible with the selected size of the segments.

The interlock members, and the additional strip if used, can be made of any suitable materials that are compatible with the intended end use environment. High performance plastic or stainless steel would be typical but ceramic, aluminum, bronze could also advantageously be used. The configurations for the interlock means can include those shown in the exemplary figures, or any other suitable configuration appropriate for the intended end use.

The invention claimed is:

1. A segment for a blade for dewatering a filtration fabric in a filtration process, the blade including a base carrier comprising a channel, the segment having a leading edge and a trailing edge and comprising (i) a fabric-contacting upper surface;

(ii) a substantially planar lower surface; and (iii) at least one interlock means having an upper surface adhesively bonded and entirely contiguous to the lower surface of the segment, the interlock means being constructed and arranged to be received and secured within the channel.

2. A segment as claimed in claim 1, wherein the at least one interlock means comprises at least one interlock member having an upper bonded end and a lower free end, the upper bonded end comprising the upper surface, the interlock member having a cross section which is diminished at an indented intermediate portion between the bonded end and the free end.

3. A segment as claimed in claim 1, wherein the at least one interlock means comprises an elongated strip having a plurality of interlock members attached thereto, each of the interlock members having an upper bonded end and a lower free end, and a cross section which is diminished at an indented intermediate portion between the bonded end and the free end.

4. A segment as claimed in claim 2, wherein the segment is provided with a plurality of the interlock members bonded to the lower surface of the segment in a spaced-apart relationship from each other.

5. A segment as claimed in claim 4, wherein the plurality is between two and four.

6. A segment as claimed in claim 1, wherein the segment is constructed of a ceramic material.

7. A segment as claimed in claim 1, wherein each of the interlock members is constructed of a material selected from high performance plastics, metals and ceramics.

8. A dewatering blade for a filtration fabric, comprising (i) a base carrier having at least one channel (ii) a plurality of segments each having a leading edge and a trailing edge and comprising (a) a fabric-contacting upper surface;

(b) a substantially planar lower surface; and (c) at least one interlock means having an upper surface adhesively bonded and entirely contiguous to the lower surface of the segment, the interlock means having a free end constructed and arranged to be received and secured within the channel.

9. A dewatering blade as claimed in claim 8, wherein each of the at least one interlock means comprises an interlock member having an upper bonded end and a lower free end, and having a cross section which is diminished at an indented intermediate portion between the bonded end and the free end.

10. A dewatering blade as claimed in claim 8, wherein each of the at least one interlock means comprises an interlock member having an upper bonded end and a lower free end, and having a cross section which is diminished at an indented intermediate portion between the bonded end and the free end, and the channel comprises a clip means constructed and arranged to engage and securely retain the interlock means at the intermediate portion.

11. A dewatering blade as claimed in claim 10, wherein the clip means is constructed of a resilient material.

12. A dewatering blade as claimed in claim 9, wherein the segment is provided with a plurality of the interlock members.

13. A dewatering blade as claimed in claim 12, wherein the plurality is between two and four.

14. A dewatering blade as claimed in claim 9, wherein each of the interlock members is secured within the channel by an adhesive at least proximate the intermediate portion of the interlock member.

15. A dewatering blade as claimed in claim 8, wherein the segments are constructed of a ceramic material.

16. A dewatering blade as claimed in claim 9, wherein each of the interlock members is constructed of a material selected from high performance plastics, metals and ceramics.

17. A method of making a dewatering blade for a filtration fabric comprising the steps of (i) providing a base carrier having at least one channel (ii) providing a plurality of segments each having a leading edge and a trailing edge and comprising (a) a fabric-contacting upper surface;

(b) a substantially planar lower surface; and (c) at least one interlock means having an upper surface adhesively bonded and entirely contiguous to the lower surface of the segment and having a free end portion; and (iii) securing the segments to the base carrier by securing the free end portion of the interlock means within the at least one channel.

18. A method as claimed in claim 17, wherein step (i) includes providing a clip means constructed of a resilient material within the channel, step (ii) includes providing an indented portion to the interlock means proximate the free end portion, and step (iii) includes pressing the free end portion into the clip means and thereby securing the indented portion.

19. A method as claimed in claim 18, wherein step (iii) further includes securing each free end portion within the channel by an adhesive.

20. A method as claimed in claim 17, wherein the segments are constructed of a ceramic material.

21. A method as claimed in claim 17, wherein the free end portions of the interlock means are constructed of a material selected from high performance plastics, metals and ceramics.

22. A method as claimed in claim 17, wherein the base carrier comprises a plurality of channels, and step (iii)

includes securing the segments of at least one channel to the base carrier such that the segments are oriented in a first direction, and securing the segments of at least one other channel such that the segments of the at least one other channel are oriented in a second direction different from the first direction.

23. A segment as claimed in claim 1, wherein the segment is for use in a papermaking machine.

24. A segment as claimed in claim 23, wherein the segment is for use in the forming section of a papermaking machine.

25. A dewatering blade as claimed in claim 8, wherein the dewatering blade is for use in a papermaking machine.

26. A dewatering blade as claimed in claim 25, wherein the dewatering blade is for use in the forming section of a papermaking machine.

27. A method as claimed in claim 17, wherein the dewatering blade is used in a papermaking machine.

28. A method as claimed in claim 27, wherein the dewatering blade is used in the forming section of a papermaking machine.

29. A dewatering box comprising at least one dewatering blade as claimed in claim 8.

* * * * *